US005421043A

United States Patent [19]

McDaniel et al.

[11] Patent Number: 5,421,043

[45] Date of Patent: Jun. 6, 1995

[54] TUBE TYPE WATERMATTRESS WITH IMMOVABLE WAVE DAMPENING INSERTS

[76] Inventors: James E. McDaniel, 4149 Ellen Dr., Covina, Calif. 91722; Arturo Lucio, 15042 Rolling Ridge Dr., Chino Hills, Calif. 91709

[21] Appl. No.: 195,392

[22] Filed: Feb. 14, 1994

[51] Int. Cl.[6] ..... A47C 27/08

[52] U.S. Cl. ..... 5/451; 5/450; 5/919

[58] Field of Search ..... 5/450, 451, 455, 919, 5/921

[56] References Cited

U.S. PATENT DOCUMENTS

| | | | |
|---|---|---|---|
| 948,644 | 2/1910 | Bjornstad . | |
| 3,683,431 | 8/1972 | Pennel et al. | 5/350 |
| 4,092,750 | 7/1978 | Ellis | 5/343 |
| 4,221,013 | 9/1980 | Echevarria | 5/451 |
| 4,247,962 | 2/1981 | Hall | 5/450 |
| 4,301,560 | 11/1981 | Fraige | 5/450 |
| 4,328,599 | 5/1982 | Mollura | 5/451 |
| 4,345,348 | 8/1982 | Hall | 5/450 |
| 4,399,575 | 8/1983 | Hall | 5/450 |
| 4,411,033 | 10/1983 | Morgan | 5/450 |
| 4,551,873 | 11/1985 | Hall | 5/450 |
| 4,577,356 | 3/1986 | Johenning et al. | 5/450 |
| 4,912,789 | 4/1990 | Maxwell | 5/451 X |
| 5,050,257 | 9/1991 | Johenning | 5/450 |
| 5,062,170 | 11/1991 | Johenning | 5/450 |
| 5,077,848 | 1/1992 | McDaniel et al. | 5/451 |
| 5,152,020 | 10/1992 | Sobie | 5/451 |
| 5,345,628 | 9/1994 | Keefer | 5/451 X |

*Primary Examiner*—Michael F. Trettel
*Attorney, Agent, or Firm*—Klein & Szekeres

[57] ABSTRACT

A watermattress includes a plurality of elongated water-filled tubes in a suitable frame, and each tube includes a wave dampening insert of foam or fiber. A base strip made of a substantially flexible material, such as vinyl, is fastened to each end of the tube. The wave dampening insert is fastened at a plurality of places along the length of the insert to the base strip, whereby the insert is substantially incapable of sliding or moving around in the tube even when one end of the tube is lifted. The foregoing feature prevents the insert from becoming dislocated and distorted in the tube as a result of extended normal use of the watermattress or even when the tube is moved or lifted for the purpose of draining, filling or moving the watermattress, and thereby makes the watermattress user friendly.

23 Claims, 3 Drawing Sheets

TUBE TYPE WATERMATTRESS WITH IMMOVABLE WAVE DAMPENING INSERTS

BACKGROUND OF THE INVENTION

1. Field of the Invention

The present invention is in the field of watermattresses. More particularly, the present invention is in the field of tube-type watermattresses having an immovable wave-dampening insert.

2. Brief Description of the Prior Art

Watermattresses have been known in the prior art for a long time. To a great many people sleeping on a watermattress offers more comfort than sleeping on conventional bedding. Nevertheless a serious disadvantage of conventional watermattresses is the wave motion of water in the mattress which, although preferred by some, is found objectionable by the majority of persons. In order to reduce or eliminate this unwanted wave motion various devices and means have been employed in the prior art. For example, U.S. Pat. No. 4,301,560 describes the use of lofted polyester fiber as a wave dampening insert in a watermattress. U.S. Pat. No. 4,411,033 describes the use of buoyant floating polyurethane foam insert as wave-dampener in a watermattress. U.S. Pat. Nos. 4,577,356, 4,551,873, 4,399,575, 4,345,348, and 4,247,962 describe the use of wave dampening baffles in watermattresses.

U.S. Pat. No. No. 4,221,013 describes the use of elongated water-filled tubes in a watermattress having a soft-sided (foam) frame of specific construction. When the water-filled tubes are disposed "head-to-toe" in the watermattress, they substantially prevent propagation of wave motion in a side-to-side direction. Inserts, (such as foam or fiber) have also been used in the prior art within the elongated tubes to dampen the propagation of wave motion in the longitudinal direction. A tube-type watermattress which has inserts capable of inhibiting wave motion and providing extra support to the back, "lumbar" area to a person resting on the watermattress is described in our U.S. Pat. No. 5,077,848.

Providing wave dampening inserts and/or baffles in a watermattress, however, is not entirely without problems. For example, baffles welded directly to the vinyl envelope which contains the water usually weaken the overall construction and eventually cause tears and leaks. Inserts, such as foam or fiber, cause their own sets of problems, such as difficulty in draining, and shifting within the water-tight envelope. In order to reduce these problems, techniques were developed in the art to facilitate draining and to anchor or tether baffles and inserts within the interior of the watermattress. Anchoring or tethering structures are described in U.S. Pat. Nos. 5,152,020, and 5,062,170. U.S. Pat. No. No. 5,050,257 describes a fiber-filled watermattress with a drainage manifold positioned beneath the fiber insert to direct water toward a drain valve, to facilitate draining of the watermattress.

With respect to tube-type watermattresses however, the problem of a fiber or foam insert sliding within the tubes, and bunching up ("balling up") within the tube, has not been solved until the present invention. This is so, because, until the present invention, the wave-dampening foam or fiber insert provided in a tube-type watermattress has been allowed to move freely within the mattress. Because users often fill the individual water-containing tubes of a tube-type watermattress at a faucet and then carry the filled tube to the bed (sometimes in a folded U-shaped configuration) or otherwise tend to lift and move the water-containing tubes of such a watermattress, the bunching up or "balling up" of inserts in the tubes is a serious problem in the art. Such bunching up of the insert can also occur over a course of time as a result of normal human activities on the watermattress. The present invention serves to eliminate this problem.

SUMMARY Of THE INVENTION

It is an object of the present invention to provide a wave-dampened tube-type watermattress which is "consumer-friendly" with respect to avoiding problems with the wave-dampening insert when individual tubes of the mattress are drained, filled or moved.

It is another object of the present invention to provide a wave-dampened tube-type watermattress wherein the wave-dampening insert in each tube avoids sliding, and bunching up or bailing-up in the tube as a result of normal human activities on the watermattress or when the tube is drained, filled, lifted at one end or is otherwise moved.

The foregoing and other objects and advantages are attained by a watermattress which includes a plurality of elongated water-filled tubes in a suitable frame, and wherein each tube includes a wave dampening insert of foam or fiber. A base strip made of a substantially flexible material, such as vinyl, is fastened to each end of the tube within the interior of the tube. The wave dampening insert is fastened at a plurality of places along the length of the insert to the base strip, whereby the insert is substantially immobilized and is incapable of sliding or moving around in the tube even when one end of the tube is lifted.

The features of the present invention can be best understood together with further objects and advantages by reference to the following description, taken in connection with the accompanying drawings, wherein like numerals indicate like parts.

DESCRIPTION OF THE PREFERRED EMBODIMENTS

Figure 1:
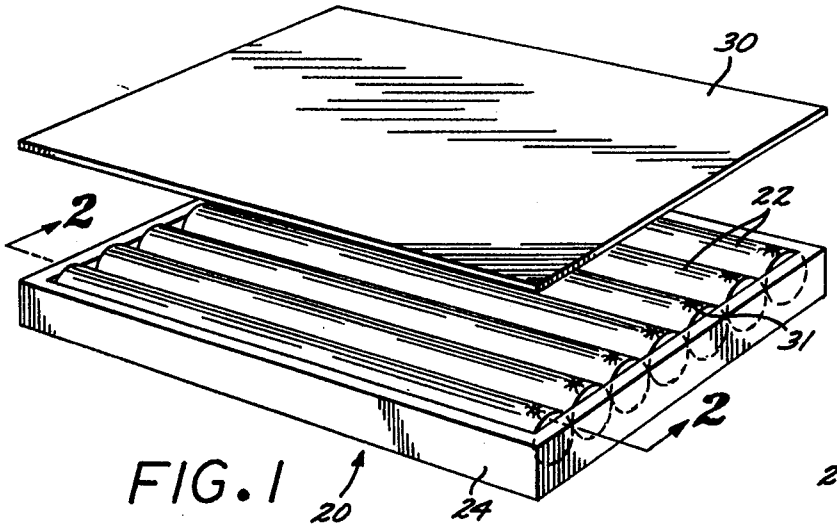
FIG. 1 is a perspective view of a tube-type watermattress incorporating the immobilized wave-dampening inserts of the present invention.

The following specification taken in conjunction with the drawings sets forth the preferred embodiments of the present invention. The embodiments of the invention disclosed herein are the best modes contemplated by the inventors for carrying out their invention in a commercial environment, although it should be understood that various modifications can be accomplished within the parameters of the present invention.

Referring now to FIGS. 1–4 of the appended drawings, a first preferred embodiment 20 of the watermattress of the present invention is disclosed. The watermattress of the present invention utilizes a plurality of elongated water containers or tubes 22 to provide a "flotation type" sleeping surface. The elongated water containers or tubes 22 are preferably disposed "head-to-toe" in the watermattress (as is shown in the herein described embodiment), although the present invention can also be utilized when the water containers or tubes are disposed cross-wise (not shown) in the watermattress. The watermattress includes a frame 24, which is usually soft-sided and is made from foam. The frame 24 forms a cavity into which the tubes 22 are placed. The frame 24 or cavity includes a bottom panel 26, side panels 28 which form vertical walls, and a top panel 30. Inasmuch as a specific construction of a tube-type watermattress is described in U.S. Pat. No. 4,221,013, a more detailed description of the tube-type watermattress is not considered necessary. The specification of U.S. Pat. No. 4,221,013 is expressly incorporated herein by reference. Quilting and fabric which conventionally covers the watermattress are not shown in the appended drawings. It is noted however, that the present invention pertains to the water containing tubes of the water-mattress, and specifically to the construction and arrangement of wave-dampening inserts therein. Therefore the present invention is not limited by the specific construction of the foam or like soft-sided cavity into which the tubes are placed. Moreover, the present invention is also applicable to tube-type watermattresses which have hard (wood) sides. Each tube 22 has a capped valve 31 to permit filling the tube 22 with water.

Generally speaking, approximately six to nine tubes 22 are used in a watermattress, the exact number depending on the size of the mattress and on the width of the tubes 22.

As is well known in the watermattress industry, the tubes 22 of a tube-type watermattress which are placed head-to-toe substantially prevent transmittal of wave motion from side-to-side. Wave dampening inserts, such as foam or fiber reduce propagation of wave motion along the length of the tubes. The tube-type watermattresses offer other advantages as well. For example, it is generally considered easier to assemble or disassemble, fill, or drain a tube-type watermattress than a single-bladder watermattress of comparable size. These particular advantages are, however accompanied by a serious drawback, in that when draining, filling or carrying an individual tube containing a wave dampening insert, it is quite common for the user to lift one or both ends of the tube thereby causing the insert to shift out of position and at worst to bunch up in the tube. This occurrence renders tube-type watermattresses with inserts of the prior art less than "user-friendly" in a sense, because straightening out and properly repositioning a bunched up insert within the water-filled tube of a watermattress is a difficult, aggravating and sometimes impossible task. Bunching up of the insert can also occur, over an extended course of time of use, as a result of normal human activities on the watermattress.

Figure 3:
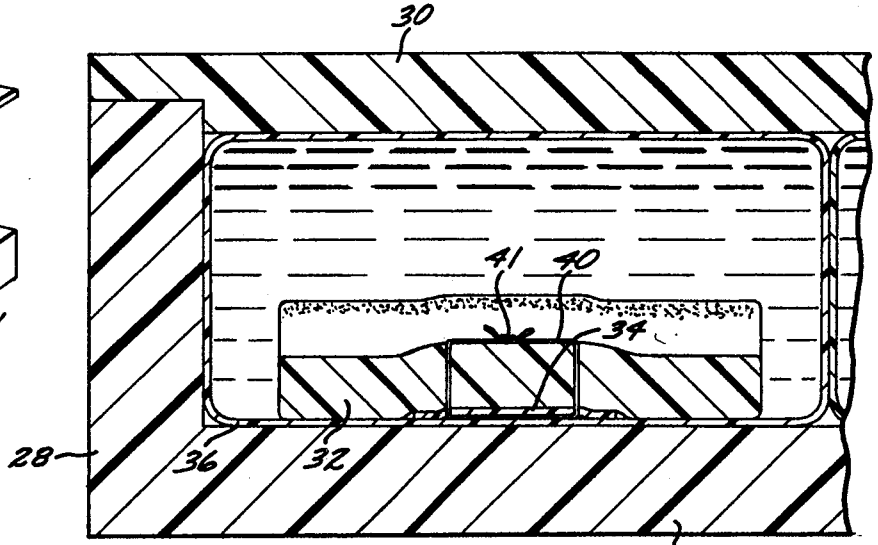
FIG. 3 is another cross-sectional view taken on lines 3,3 of FIG. 2.
Figure 2:
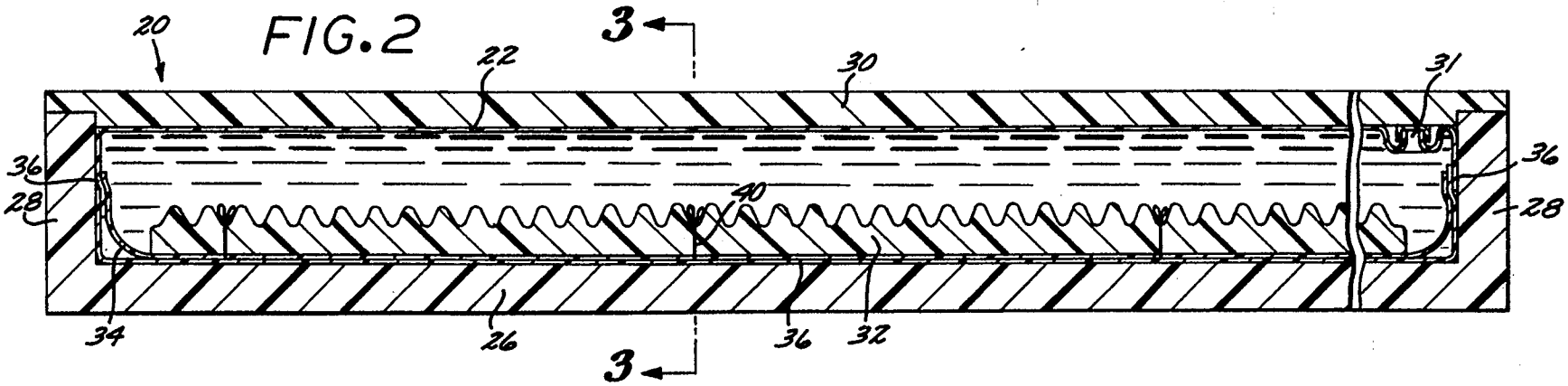
FIG. 2 is a cross-sectional view taken on lines 2,2 of FIG. 1.
Figure 4:
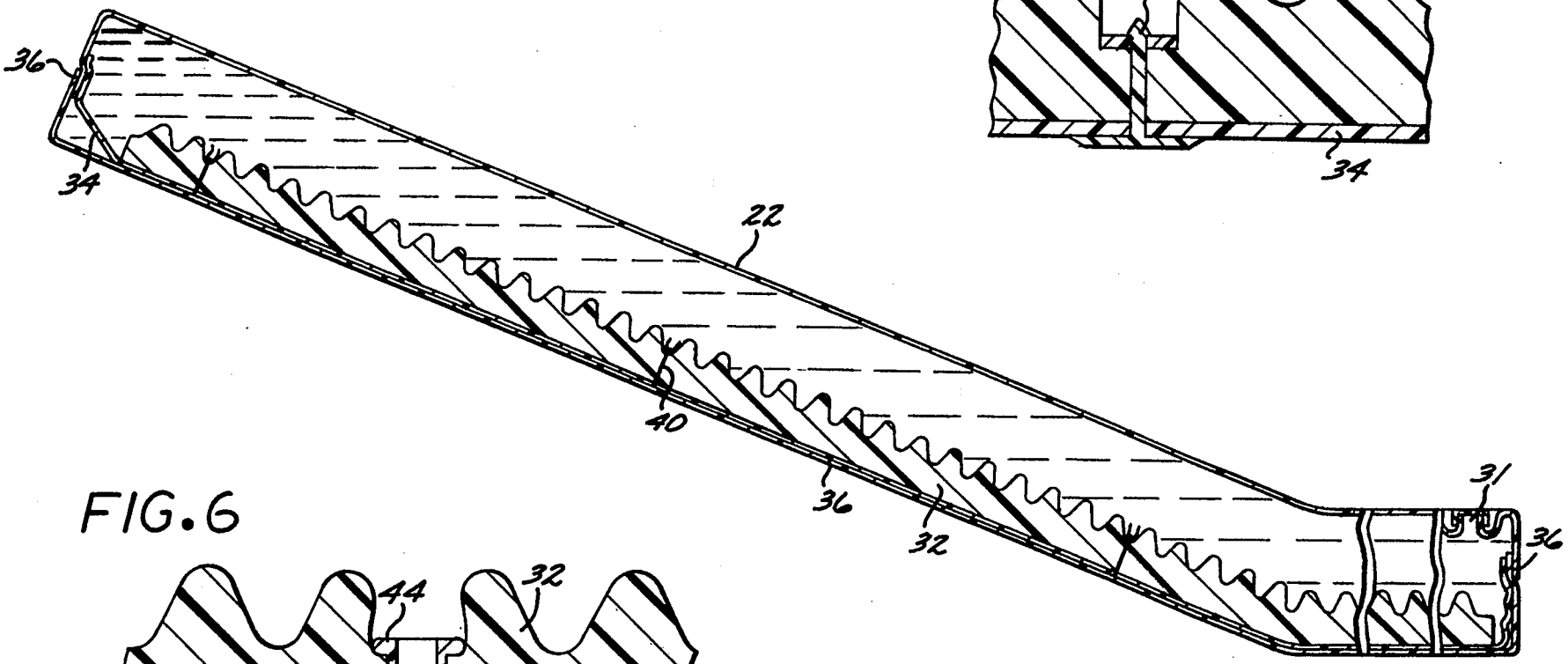
FIG. 4 is a cross-sectional view of a tube of the watermattress containing the immobilized wave dampening insert, analogous to the view of FIG. 2 but showing the tube lifted at one end thereof, as in the process of draining or moving the tube.

FIGS. 2, 3 and 4 show the preferred embodiment of the present invention, where, in order to solve the above-noted problem, a foam insert 32 is fastened substantially immovably within the tube 22. Specifically, as is shown in these drawing figures, a base strip or retention strip 34 is attached to the tube 22. The purpose and function of the retention strip 34 is to provide anchor points or tie-down points for substantially immovably fastening the insert 32 within the tube 22. The retention strip 34 itself must be sufficiently securely attached within the tube 22 so that it can perform its function of anchoring the insert 32 and support its weight when one end of the tube 22 is lifted, as is shown in FIG. 4. The preferred manner of constructing and incorporating the retention strip 34 in the tubes 22 is disclosed in the herein described embodiments. Thus, the retention strip 34 is preferably made from vinyl material, preferably from vinyl of approximately the same thickness as the vinyl wall of the tube 22. In this regard it is noted that usually the vinyl wall of tube is of at least 20 mil thickness, and that in the State of California this thickness is mandated by law. The retention strip 34 also needs to be sufficiently wide in order to have the required strength, as described above, and for this reason it is preferably approximately 3 to 3.5 inches wide. The retention strip 34 is welded to the wall of the vinyl tube 22 at each end of the tube 22, proximate to the same welded seam 36 which is utilized to construct the tube 22. As it can be seen from the drawing figures, the rest of the retention strip 34 is not fastened to the tube 22, so that along the length of the tube 22 the retention strip 34 merely rests on the bottom wall 38 of the tube 22.

The wave dampening insert 32 of the first preferred embodiment comprises open cell foam (such as open cell polyurethane foam), which on its upper surface is "convoluted", that is, has egg crate like configuration. The concept of using open cell foam, and specifically convoluted open cell foam as a wave dampening insert, is per se well known in the art. Convoluted foam can be made with state-of-the art convoluting machine, and is available commercially. It should be specifically understood that the height (thickness) of the foam or other insert within the tube 22 depends on the amount of wave suppression desired and does not limit the present invention. Consequently, the foam insert 32 may be high (thick) enough to fill substantially the whole volume of the tube 22, or may only fill the tube 22 partially, as is shown in the drawing figures. In order to provide the desired effect along substantially the entire length of the tube 22, the insert 32 is only slightly shorter than the tube 22, as is shown in FIG. 2.

In accordance with the present invention the insert 32 is disposed above the retention strip 34 and is affixed to the retention strip 34 at several points. In accordance with the preferred embodiment, the insert 32 is attached to the underlying retention strip 34 at five locations, three of which are shown in FIG. 2. Preferably, the points of attaching the insert 32 to the retention strip 34 are evenly spaced along the length of the insert 32, and in the preferred embodiment these points are at approximately twelve inches from one another. It will be readily understood by those skilled in the art that more or less points of attachments, and correspondingly smaller or greater distances between the points of attachment are possible within the scope of the invention.

Figure 5:
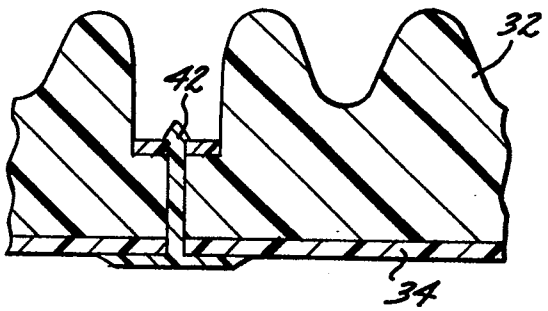
FIG. 5 is a partial view of a second embodiment of the tube of the watermattress containing the immobilized wave dampening insert, the view showing attachment of the insert to a retention strip by clips.
Figure 6:
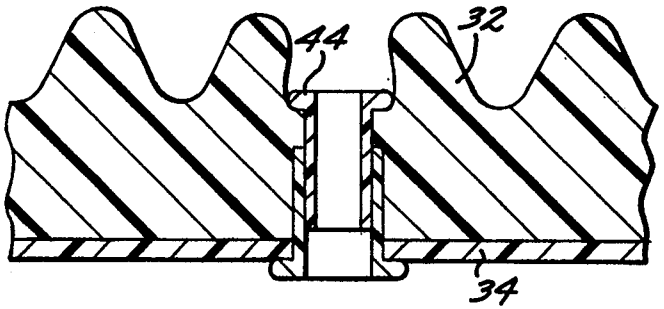
FIG. 6 is a partial view of a third embodiment of the tube of the watermattress containing the immobilized wave dampening insert, the view showing attachment of the insert to a retention strip by grommets.

Referring now primarily to the cross-sectional view of FIG. 3, the preferred mode of attaching the insert 32 to the retention strip 34 is shown. Specifically, polyester twine 40 is used to tie the insert 32 to the strip 34. For this purpose two holes are provided in the strip 34 and also substantially perpendicularly through the insert 32, the twine 40 is led through the holes and is tied into a knot 41 on the top of the insert 32. Instead of polyester twine, twine or string made from other water resistant materials, such as nylon, or even vinyl, could be used for this purpose. An important advantage of using twine or rope is that these materials are soft and therefore do not present a hard object which may be felt by a person resting on the watermattress, even if the person "bottoms out" on the mattress. Those skilled in the art will nevertheless recognize in light of the foregoing disclosure that there are many alternative but presently less preferred means for attaching the insert 32 to the retention strip 34. For example, the partial view of FIG. 5 illustrates a second preferred embodiment wherein a plastic clip 42 (similar in principle of operation to a toggle bolt) affixes the foam insert 32 to the retention strip 34. The partial view of FIG. 6 discloses a third preferred embodiment where a grommet 44 is used to affix the foam insert 32 to the retention strip 34. As it can be seen on the drawing figure, the grommet 44 has two parts which can be affixed to one another by friction fit, or with glue. As it was noted above, however, the preferred method for fastening the insert 32 to the underlying retention strip 34 is by means which include no hard surfaces and therefore cannot be felt by a person resting on the mattress, even if the mattress bottoms out.

FIG. 4 schematically illustrates a tube 22 of the first preferred embodiment 20 in a position in which the tube 22 is when one end of the tube 22 is lifted. Such lifting may occur in connection with draining, or carrying the tube 22, or in order to reach into the cavity of the mattress below the tubes 22. The drawing figure illustrates that the insert 32 is substantially immobilized in the tube 22, it does not shift position, does not bunch up or ball up in the tube 22, and therefore the mattress is "consumer friendly".

Figure 7:
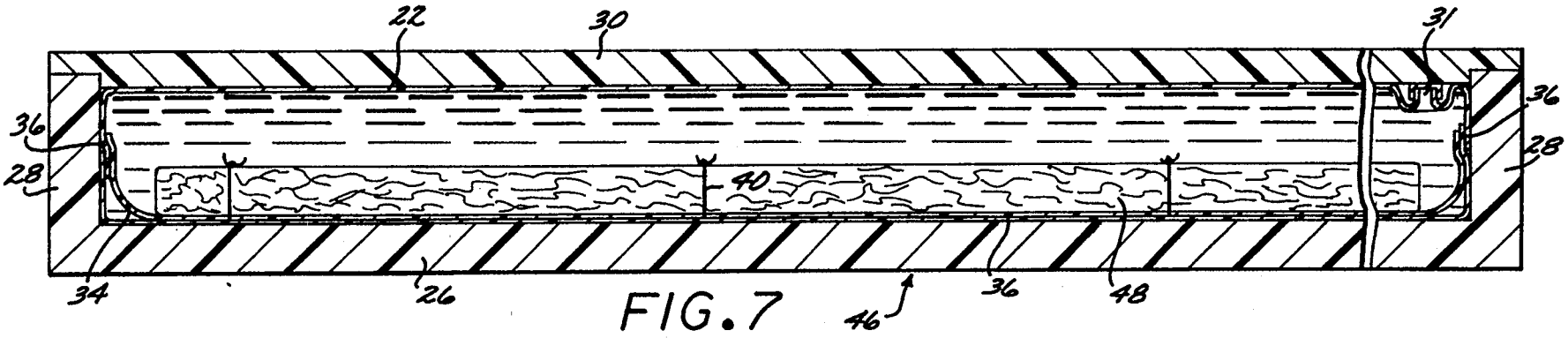
FIG. 7 is a cross-sectional view, analogous to the view of FIG. 2, showing a fourth preferred embodiment of the watermattress of the present invention wherein the immobilized wave dampening insert is fiber.

FIG. 7 illustrates a fourth embodiment 46 of the watermattress of the invention wherein a fiber pad 48 comprises the wave dampening insert which is tied with polyester twine 40 to the underlying retention strip 34.

Figure 8:
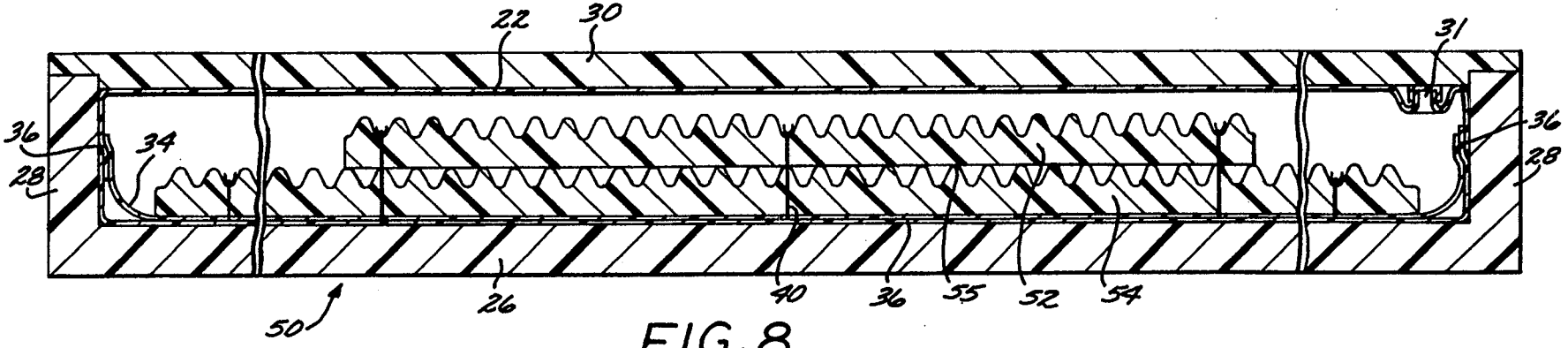
FIG. 8 is a cross-sectional view, analogous to the view of FIG. 2, showing a fifth preferred embodiment of the watermattress of the present invention wherein the immobilized wave dampening insert of the mattress is foam adapted for lumbar support.

FIG. 8 illustrates a fifth preferred embodiment 50. The fifth preferred embodiment 50 is constructed, at least in part, in accordance with the disclosure of our U.S. Pat. No. 5,077,848, the specification of which is incorporated herein by reference. Briefly summarizing those features of this embodiment 50 which are in accordance with the 5,077,848 patent, the insert in the tube 22 is substantially thicker in the center of the tube in the area where a person's back is likely to be located when the person rests on the watermattress. This is best accomplished by affixing a second piece of foam insert 52 on top of a first piece of foam insert 54, thereby forming a unitary insert 55 thus adapted for lumbar support. In accordance with the present invention, the unitary lumbar support insert 55 is affixed at a plurality of places and preferably with polyester twine to the underlying retention strip 34. Presently, six evenly spaced tie-down points are utilized in the herein described preferred embodiment of the tube 2Z having the lumbar support insert Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A water container to be used in a waterbed mattress, comprising:

an elongated tube, having pliant but substantially non-stretchable walls and valve means for filling the tube with water and for capping the water-filled tube, said walls including a bottom wall, and first and second end walls at respective opposite ends of the tube;

a substantially flexible strip of material disposed within the interior of the tube and affixed to each end of the tube, the strip of material having sufficient length so that when the tube is disposed substantially horizontally the strip normally rests on the bottom wall of the tube;

a wave dampening filler insert container within the tube disposed above the strip of flexible material, and means for affixing the wave dampening filler insert to the strip at a plurality of locations, whereby the wave dampening filler insert is substantially immobilized in the tube and is substantially incapable of shifting position therein.

2. The water container of claim 1 wherein the wave dampening filler insert comprises open cell foam.

3. The water container of claim 1 wherein the wave dampening filler insert comprises lofted fiber material.

4. The water container of claim 1 wherein the flexible strip of material is vinyl.

5. The water container of claim 4 wherein the walls of the tube are vinyl and wherein the flexible strip of vinyl is welded to each end of the tube.

6. The water container of claim 5 wherein the only points of welding the flexible strip of vinyl to the tube are at the ends of the tube.

7. The water container of claim 1 wherein the means for affixing the wave dampening filler insert to the strip at a plurality of locations comprise tying means made from water resistant material, for tying the filler insert to the flexible strip at each location.

8. The water container of claim 7 wherein the tying means comprise polyester twine.

9. A wave-dampened tube to be used in a waterbed mattress of the type containing a plurality of elongated water-filled tubes to provide a sleeping surface, the tube comprising:

pliant and substantially non-stretchable vinyl walls which form a water-tight envelope for the tube, the walls including a bottom wall and first and a second end walls with each end wall incorporating a welded seam of the envelope;

a substantially flexible strip of vinyl disposed within the interior of the tube and welded to each end wall of the tube, the strip of vinyl having sufficient length so that when the tube is disposed substantially horizontally the strip normally rests on the bottom wall of the tube;

a wave dampening filler insert container within the tube disposed above the strip of vinyl, and means for affixing the wave dampening filler insert to the strip of vinyl at a plurality of locations, whereby the wave dampening filler insert is substantially immobilized in the tube and is substantially incapable of shifting position therein.

10. The wave-dampened tube of claim 9 wherein the wave dampening filler insert comprises open cell foam.

11. The wave-dampened tube of claim 9 wherein the wave dampening filler insert comprises lofted fiber material.

12. The wave-dampened tube of claim 10 wherein the means for affixing the foam insert to the strip of vinyl comprise means for tying the insert at each location to the strip located below.

13. The wave-dampened tube of claim 12 wherein the means for tying comprise polyester twine.

14. The wave-dampened tube of claim 11 wherein the means for affixing the fiber insert to the strip of vinyl comprise means for tying the insert at each location to the strip located below.

15. The wave-dampened tube of claim 14 wherein the means for tying comprise polyester twine.

16. The wave dampened tube of claim 9 wherein the wave dampening filler insert comprises a first elongated insert the material of which is selected from open cell foam or lofted fiber, the first elongated insert being disposed substantially along the entire length of the tube, and a second elongated insert the material of which is selected from open cell foam or lofted fiber, the second elongated insert being disposed in the tube substantially in the center portion thereof attached to and above the first insert, whereby the center portion provides a firmer sleeping surface than the end portions of the tube.

17. The wave-dampened tube of claim 16 wherein the means for affixing the insert to the strip of vinyl comprise means for tying the insert at each location to the strip located below.

18. The wave-dampened tube of claim 17 wherein the means for tying comprise polyester twine.

19. A waterbed mattress comprising a soft-sided frame and a plurality of water-filled elongated tubes which are adjacent to one another and jointly provide a sleeping surface, each of the tubes having pliant but substantially non-stretchable walls and valve means for filling the tube with water and for capping the water-filled tube, each tube having a bottom wall and first end second end walls at respective opposite ends of the tube;

a substantially flexible strip of material disposed within the interior of each tube and affixed to each end of the tube, the strip of material having sufficient length so that when the tube is disposed substantially horizontally the strip normally rests on the bottom wall of the tube;

a wave dampening filler insert container within each tube disposed above the strip of flexible material, and means for affixing the wave dampening filler insert to the strip at a plurality of locations, whereby the wave dampening filler insert is substantially immobilized in the tube and is substantially incapable of shifting position therein.

20. The waterbed mattress of claim 19 wherein the walls of the tube consist essentially of vinyl material, the flexible strip consists essentially of vinyl material, and wherein the flexible strip is affixed to each end wall of the tube by welding.

21. The waterbed mattress of claim 19 wherein the wave dampening filler insert is open cell foam.

22. The waterbed mattress of claim 19 wherein the wave dampening filler insert is lofted fiber.

23. The waterbed mattress of claim 19 wherein the means for affixing the insert to the strip comprise means for tying the insert at each of the plurality of locations to the strip.

* * * * *